United States Patent [19]

Haasis, Jr.

[11] 4,338,794

[45] Jul. 13, 1982

[54] HIGH EFFICIENCY ICE-MAKING SYSTEM

[76] Inventor: Hans Haasis, Jr., 1421 Duarte Cir., Simi Valley, Calif. 93065

[21] Appl. No.: 130,691

[22] Filed: Mar. 17, 1980

[51] Int. Cl.[3] ..... F25C 1/00

[52] U.S. Cl. ..... 62/348; 62/506

[58] Field of Search ..... 62/348, 279, 506

[56] References Cited

U.S. PATENT DOCUMENTS

| | | | |
|---|---|---|---|
| 2,296,997 | 9/1942 | Knoy | 62/279 |
| 2,355,289 | 8/1944 | Gibson | 62/279 |
| 2,775,100 | 12/1956 | Howe | 62/348 |
| 2,921,447 | 1/1960 | Gottschalk | 62/348 X |
| 2,949,252 | 8/1960 | Bayston | 62/348 X |
| 3,355,908 | 12/1967 | Anglin | 62/279 X |
| 3,791,163 | 2/1974 | Dickson et al. | 62/347 |
| 4,163,373 | 8/1979 | van der Sluys | 62/279 |

*Primary Examiner*—William E. Tapolcai, Jr.
*Attorney, Agent, or Firm*—Poms, Smith, Lande & Rose

[57] ABSTRACT

The waste water from an ice cube making machine, both from the cube unit itself and from the bin where the ice cubes are stored is supplied to an insulated heat exchanger. The heat exchanger is divided into two sections with a first cold input section being separated from the remaining portion of the unit by a baffle to avoid undue mixing of the water, and to maintain the water at the input section at a low temperature, near freezing. A heat exchange coil is located in the first section of the heat exchanger and water to be formed into ice is precooled by circulation through this coil. Additional coils are located in the remaining portion of the heat exchanger to further cool refrigerant liquid which has been condensed and is under pressure ready for return to the ice-making units. The temperature in the input section of the heat exchanger is in the order of 34 degrees F., and the temperature in the second section of the heat exchanger may range from about 38 degrees just beyond the baffle which separates the two sections up to about 98 or 100 degrees F. close to the output from this second section of the heat exchanger.

7 Claims, 5 Drawing Figures

HIGH EFFICIENCY ICE-MAKING SYSTEM

FIELD OF THE INVENTION

The present invention relates to ice making systems.

BACKGROUND OF THE INVENTION

Machines for making ice and more particularly for making ice cubes are widely used, particularly in bars, hotels, motels, and the like. These units characteristically are unitized and can be increased in their capacity by the addition of supplemental ice-making units which can be added to the standard bin storage unit. In some instances, the units can selectively have from one to five ice-cube making units stacked on top of the main base which includes the ice cube bin storage compartment. The units are normally rated on the basis of pounds of ice which are produced by the units under ideal conditions during a 24-hour period. A "400 pound" unit makes 400 pounds of ice in 24 hours under ideal conditions. In one particular case, however, where three units were mounted on top of the base, and no additional head room or other space was available in the particular building where the unit was located, only about 1,000 pounds per day were being produced, instead of the rated 1200 pounds. This was in part due to the fact that the temperature of the water which was being supplied to the machines for making ice was in the order of 83 degrees F., because the input line to the ice-cube making unit came through the attic, and the relatively slow rate of flow caused the incoming water to be warmed to close to the attic temperature. In the particular installation, there was no additional space available for installing additional units, and in all events, such additional units would have been quite expensive, costing in the order of $2,000 or $3,000 for each additional unit to be added to an existing installation, and substantially more for a second base and complete installation, if there had been enough space for such a second installation.

In accordance with one aspect of the present invention, it was discovered that substantial quantities of ice cold water are actually drained from ice-making machines in the course of the "harvest" cycle and also from the storage bin. More specifically, it has been determined that in each harvest cycle from each unit, in the order of one or two gallons of cold water close to freezing temperature are lost. Accordingly, with three units, and a harvest cycle occurring four times or more per hour, in the order of 12 to 25 gallons of water are drained from the ice-making units themselves each hour. In addition, although the ice bins in which the ice cubes are stored are insulated, substantial quantities of additional drain water result from some melting of these cubes.

SUMMARY OF THE INVENTION

In accordance with the present invention it was determined that, particularly with the relatively small quantities of input water which are supplied to an ice-making machine, that the cold water which is normally wasted from these installations may be effectively employed to pre-cool both the input water to the ice-making units, and also to further cool the refrigeration liquid, so that the output from the unit may be greatly increased. More specifically, in one particular installation, following the addition of the heat exchanger, the output went up from in the order of 1,000 pounds per day to substantially above the rated output of 1200 pounds per day for the three unit installation.

In one specific implementation, the system involves the use of a heat exchanger having two principal compartments separated by a baffle plate. Cold drain water from the ice-making machine is supplied to the first cold compartment of the heat exchanger and it proceeds past the baffle plate into the second section of the heat exchanger and is eventually drawn off and dumped from the far end of the second section of the heat exchanger. Input potable water is supplied to a heat exchange coil within the first section, and one or more refrigeration liquid return conduits are coupled to additional coils in the second section of the heat exchanger. The temperature within the heat exchanger ranges from approximately 34 degrees at the input to the first section to approximately 38 degrees as the water passes through the baffle and up to about 98 degrees or 100 degrees F. at the output from the heat exchanger.

The heat exchanger may either be circular, for ease and low cost of manufacture, whereby a simply large diameter section of pipe, such as four inches, six inches or more in diameter, may be employed as the outer casing for the heat exchanger; or the heat exchanger may be of a relatively flat configuration in order to easily mount it under the base or the ice bin of the ice-making machine.

Other objects, features, and advantages of the invention will become apparent from a consideration of the following detailed description and from the accompanying drawings.

DETAILED DESCRIPTION

Figure 1:
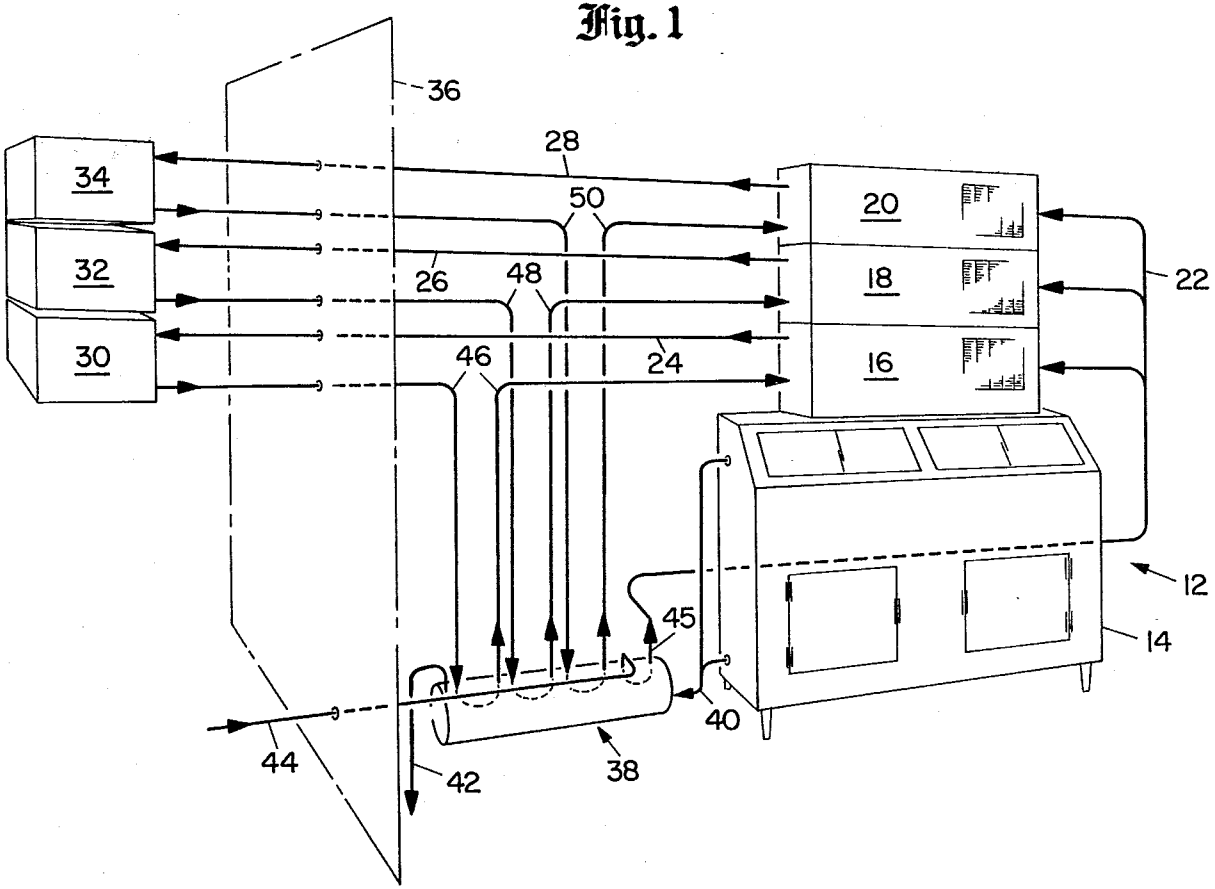
FIG. 1 is a schematic showing of a high efficiency ice-making system illustrating the principles of the present invention.

Referring more particularly to the drawings, FIG. 1 shows an ice-making machine 12 including a base 14 which contains the ice storage bin, and three ice cube making units 16, 18 and 20 which may be mounted on top of the base 14 and from which ice cubes are periodically harvested and automatically drop down into the bin within the base 14. Incidentally, although the units shown happen to be substantially in the form of those made by one manufacturer of such installations, the present invention is also applicable to comparable units made by other manufacturers. In the normal refrigeration cycles, refrigeration liquid, such as freon, is expanded within the ice-making units 16, 18 and 20, and the low temperature produced as the liquid turns to gas is employed to freeze the water supplied through the input potable water lines 22; and then the freon gas from units 16, 18 and 20, are routed via lines 24, 26 and 28 to the heat exchanger and condenser units 30, 32 and 34, respectively. The vertical dashed line 36 represents the wall of the building so that the heat exchanger and condenser units 30, 32 and 34 are located outside to reduce the air conditioning load within the building where the ice-making installation 12 is located. The units 16, 18 and 20 may have the heat exchangers and condensers located within them, for convenience of installation, but at the cost of additional air conditioning loading.

The heat exchanger unit 38 has the drain water from the ice machine coupled to it through the conduit 40. The drain water from conduit 40 passes through two successive sections within the heat exchanger 38 as described below, and then is routed by the output line 42 to a suitable drain or the sewer. Potable input water to be made into ice is supplied through line 44 to the input section of the heat exchanger 38 where the cold water from the drain conduit 40 maintains the temperature close to the freezing point of water. The output conduit 45 from the coil in the first (cold) section of the heat exchanger 38 is connected to the input conduits 22 to the three ice-making units 16, 18 and 20.

There are three additional coils included in the second section of the heat exchanger 38, which second section is separated from the input cold section by a baffle plate. These three additional coils are connected to receive the condensed refrigeration liquid being supplied on lines 46, 48 and 50 to the ice-making units 16, 18 and 20, respectively. Routing the condensed liquid through the heat exchanger 38 serves to additionally cool the condensed refrigeration fluid, and further increases the efficiency of the ice-making units.

Figure 2:
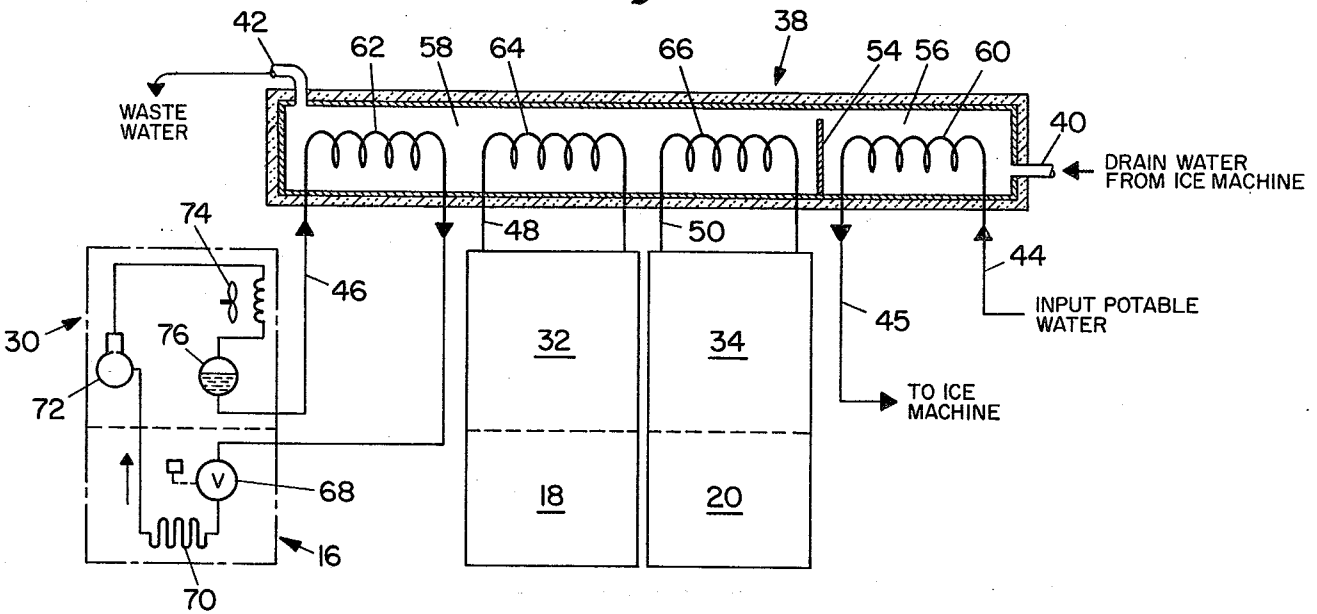
FIG. 2 is a diagram of the heat exchanger and associated refrigeration equipment employed in the system of FIG. 1.

FIG. 2 is a diagrammatic showing indicating more completely the mode of operation of the refrigeration portion of the system of FIG. 1. Initially, it may be noted that the heat exchanger 38, the refrigeration units 16, 18 and 20, and their associated heat exchangers and condensers 30, 32 and 34 are all shown in FIG. 2. In addition, the input line 40 and the output line 42 by which the cold waste water from the refrigeration unit is passed through the heat exchanger 38, also appear in FIG. 2. In FIG. 2, the baffle plate 54 by which the input section 56 and the second section 58 of the heat exchanger 38 are divided, is also shown. Coil 60 by which the input water from line 44 is cooled, is located in the initial cold section 56 of the heat exchanger 38; and the additional coils 62, 64 and 66 serve to further cool the refrigerant liquid supplied through lines 46, 48 and 50. The cooled refrigerant liquid from coil 62 is permitted to expand at the valve 68 within the unit 16 and is supplied to the ice-cube freezing unit represented by the coils 70 in FIG. 2. The gaseous refrigerant is then compressed by the pump 72 and is cooled by the fan and cooling coil unit 74 within the heat exchanger unit 30. The liquid refrigerant is then collected in the chamber 76, and is supplied to the coil 62 for further cooling.

Figure 3:
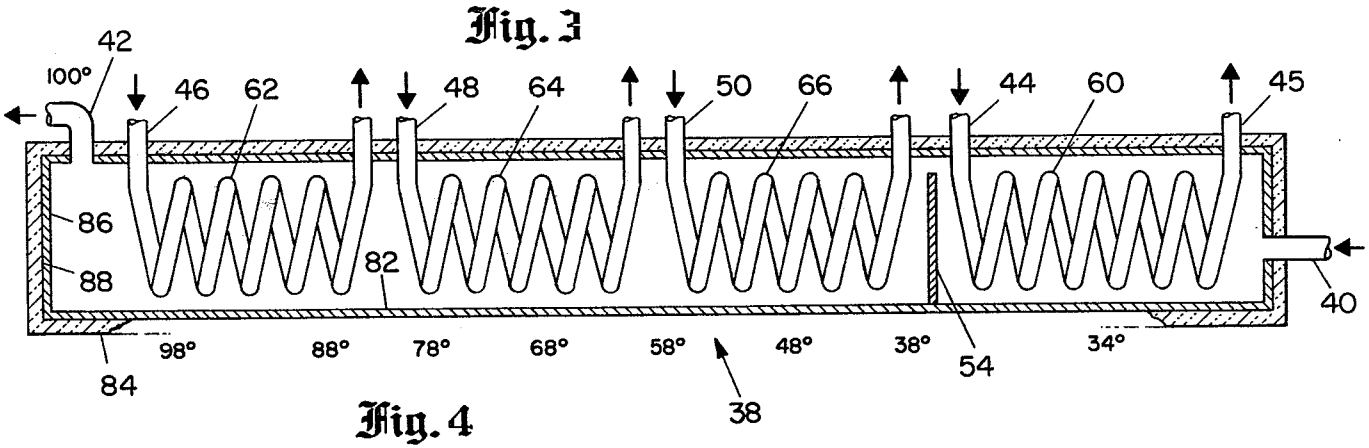
FIG. 3 is a longitudinal cross-sectional view of a heat exchanger which may be utilized in the system of FIGS. 1 and 2.

FIG. 3 is an enlarged showing of the heat exchanger 38. It may include the main body of the heat exchanger, which may be in the form of a large diameter metal pipe 82 covered with a layer of insulation 84. The housing 82 may be formed of a commercially available pipe four, five, or six inches in diameter, depending on the desired capacity of the heat exchanger, and the end plates 86 and 88 may be circular. The input and output conduits and the coils passing through the sidewalls of pipe 82 may be braised or soldered into position. The coils 60, 62, 64 and 66 may be formed of copper tubing. In one successful installation, the heat exchanger 38 was four inches in diameter and was 40 inches long. The coil 60 for the potable water to be supplied for making ice cubes was of copper tubing $\frac{1}{2}$ inch in diameter, and the three refrigerant cooling coils 62, 64 and 66 were each made of copper tubing $\frac{3}{8}$ inch in diameter.

Figure 4:
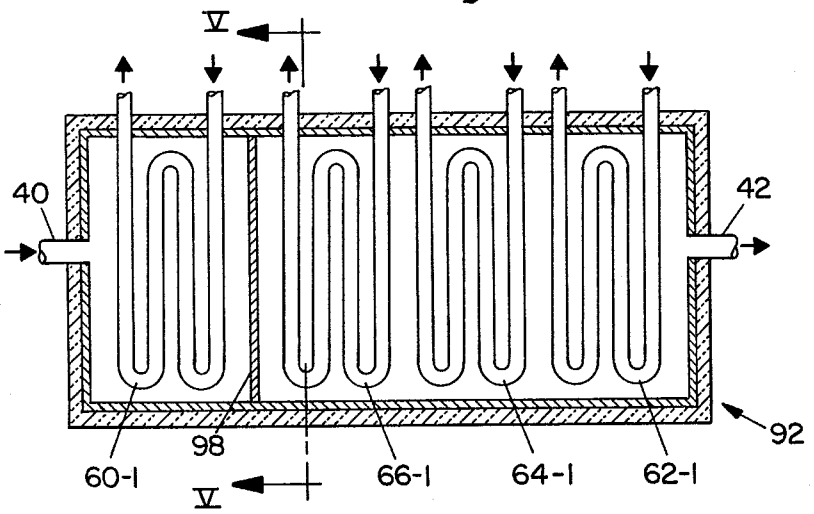
FIG. 4 is a cut-away top view of an alternative flat embodiment of a heat exchanger which may be employed in the system of FIGS. 1 and 2.
Figure 5:
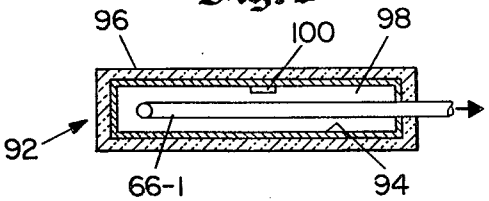
FIG. 5 is a cross-sectional view taken along lines V—V of FIG. 4.

FIGS. 4 and 5 show an alternative embodiment of the heat exchanger in which the unit 92 is flat, instead of being circular as shown in the arrangement of FIG. 3. More specifically, the unit includes the rectangular metal heat exchanger body 94, an outer layer of insulation 96, and the baffle plate 98 provided with a small rectangular aperture 100, in addition to the flat coils 60-1, 62-1, 64-1, and 66-1. The unit as shown in FIGS. 4 and 5 is in the order of 2 inches in height, approximately 24 inches wide and 40 inches long. It is constructed so that it may be mounted directly under the base 14 of the ice cube machine 12, and still be mounted off the floor, in installations of the type shown in FIG. 1.

It is again noted that, through the use of the heat exchange arrangements as disclosed herein, the output of ice was increased by approximately 18 percent to 20 percent or more when measured in pounds of ice produced per interval of time. More specifically, the total amount of ice produced by a KoldDraft brand installation increased from approximately 1,000 pounds per day to in excess of 1200 pounds per day. Incidentally, when the present installation was discussed with persons skilled in the refrigeration field, they were greatly surprised at the results which were achieved, principally on the basis that they had believed that there would not be sufficient drain water from the refrigeration unit to justify the installation. However, it is believed that (1) the unexpected substantial amount of output drain water, the additional fact that (2) the temperature of this waste water is close to the freezing point, together with (3) the relatively small amount of water input required by the ice-making machines, permits the surprising results detailed hereinabove. It is also noted that the use of the baffle plate to prevent mixing of the very cold input water with the water which has been heated by the refrigerant, contributes to the advantageous results achieved in the present system.

In conclusion, it is to be understood that the specific embodiments described hereinabove and shown in the accompanying drawings are merely illustrative of the principles of the invention and that other alternatives are within the scope thereof. More specifically, the principles described herein may be employed with other refrigeration machines, with units having self-contained heat exchanger and condenser units, through the use of alternative types of heat exchangers, or using cold condensation or cold contaminated waste water supplied to the heat exchanger unit to cool either liquid refrigerant or water to be formed into ice. Accordingly, the present invention is not limited to that precisely as described and disclosed herein.

What is claimed is:

1. A high production ice-making system comprising:

an ice-making system including a base having a storage bin and at least one ice-making and harvesting unit;

heat-exchanger means including a first input cold section and a second section;

means for supplying drain water from said ice-making unit to said heat exchanger means to flow through said heat exchanger means from said input cold section to said second section;

a first coil mounted within the input section of said heat exchanger means;

means for routing input water to be frozen through said first coil and then to said ice-making unit;

at least one additional heat exchange coil mounted in the second section of said heat exchanger means;

means for routing the condensed liquid refrigerant coolant for said ice-making unit through said additional coil to further cool said refrigerant liquid below the ambient temperature prior to the expansion of said refrigerant liquid within said ice-making unit; and said heat exchanger means being provided with means located between the first and second sections thereof to avoid undue mixing of the cold water supplied to said heat exchanger.

2. A system as defined in claim 1 wherein said heat exchanger means is generally cylindrical in configuration.

3. A system as defined in claim 1 wherein said heat exchanger means is in the form of a flat box having dimensions less than the space under the base of the ice-cube-making unit, whereby it may be mounted directly thereunder.

4. A high production ice-making system as defined in claim 1 wherein said heat exchanger means is located outside of the ice-making unit and bin.

5. A high production ice-making system as defined in claim 1, wherein said means for supplying drain water from said ice-making unit includes means for supplying waste water from said storage bin to said heat exchanger means.

6. A high production ice-making system as defined in claim 1 including a plurality of ice making and harvesting units mounted on said base, means for collecting waste water from each of them, and means for cooling refrigerant liquid associated with each said unit, mounted in said heat exchanger means.

7. An economical refrigeration system comprising:

an ice-making unit, said ice-making unit producing cold waste water;

valve means for permitting refrigerant liquid to expand to the gaseous state within said ice-making unit;

means for compressing the gaseous coolant and for reducing its temperature, and for collecting the liquid refrigerant;

a heat exchanger unit;

means for collecting the cold waste water from said refrigeration unit and supplying it to said heat exchanger units;

means including coils mounted in said heat exchanger unit for cooling liquid to be supplied to said ice-making unit;

means for routing water to be supplied to said ice-making machine through one of said coils within said heat exchanger units; and means for coupling said liquid refrigerant through one of said coils to further cool, or sub-cool said refrigerant prior to application to said ice-making unit; and baffle means mounted in said heat exchanger unit between said two coils.

* * * * *